United States Patent [19]

Morifuji et al.

[11] Patent Number: 4,488,563

[45] Date of Patent: Dec. 18, 1984

[54] FILTER PLUG

[75] Inventors: Kazuhiko Morifuji; Hirohumi Okura; Takashi Sakai, all of Toyama, Japan

[73] Assignees: Mitsubishi Acetate Co., Ltd.; Mitsubishi Rayon Co., Ltd., both of Tokyo, Japan

[21] Appl. No.: 373,153

[22] Filed: Apr. 29, 1982

[51] Int. Cl.[3] ..... A24D 3/04

[52] U.S. Cl. ..... 131/336; 131/340; 131/341; 131/344

[58] Field of Search ..... 131/344, 338, 345, 339, 131/341, 340, 336

[56] References Cited

U.S. PATENT DOCUMENTS 4,007,745 2/1977 Randall et al. ..... 131/341
4,316,475 2/1982 Suzuki et al. ..... 131/340
4,354,889 10/1982 Berger ..... 131/340
4,364,403 12/1982 Horsewell et al. ..... 131/340
4,390,031 6/1983 Berger ..... 131/336

*Primary Examiner*—V. Millin
*Attorney, Agent, or Firm*—Armstrong, Nikaido, Marmelstein & Kubovcik

[57] ABSTRACT

A filter plug having a dual structure comprising filter element A made from a crimped long filter tow in a form of a plug, filter element B, joined to said A, prepared by wrapping a core material consisting of a long fiber tow in a sheet-formed product having grooves which is formed from a material having an air permeability of 8 liters/minute or less and an air permeable wrapping paper and/or a wrapping paper with perforated openings on its periphery which is wrapping therein said filter elements A and B so that the outer grooves parts of the sheet-formed product pass through in the longer direction of the filter plug.

9 Claims, 5 Drawing Figures

FILTER PLUG

This invention relates to a plug for cigarette filter, and more particularly to a filter plug having a unique dual structure.

Recently, development of filter plug capable of removing the harmful components, particularly the particulate components, in cigarette smoke with high efficiency is advanced in order to solve the problem of health damage caused by smoking. As filter plugs hitherto developed, there can be referred to the filter plug packed with an increased amount of filter material, as well as filter plugs packed with a fiber having increased surface area prepared by increasing its fineness or by making its section irregular. Although these filter plugs have an enhanced removal rate of the particulate components contained in cigarette smoke, they necessarily yield a higher resistance to suction and therefore injure the feeling at the time of smoking a cigarette. In view of above, the present inventors previously developed a plug for cigarette filter having a unique structure shown by filter element B in FIG. 1 mentioned later with which the above-mentioned object could be achieved to a considerable extent. However, it was found that, in the cigarette to which this filter plug was attached, the cigarette smoke flowed into the groove made from the sheet-formed product having grooves (hereinafter, referred to as "corrugated sheet") so that filtration of the smoke could occur eccentrically. Thus, the inventors conducted studies with the aim of overcoming this fault to discover that the object could be achieved by making a dual structure filter prepared by joining a filter made from long fiber tow to a filter having a corrugated sheet on its outer periphery and having a long fiber tow in its core part. Based on the discovery, this invention was accomplished.

The essentiality of this invention consists in a filter plug having a dual structure which is generally formed by joining filter element A made from a crimped long fiber tow to filter element B prepared by winding a corrugated sheet having grooves which have an air permeability of 8 liters/minute or less, over a crimped long fiber tow so as to make an approximately one round and further wrapping an air permiable wrapper paper and/or a wrapper paper with perforated openings on its periphery and integrating them.

Hereunder, this invention will be explained in detail with reference to the drawings attached.

In FIG. 1 and FIG. 2, the marks mean the followings:

1, 2—long fiber tow
3—groove part in the axial direction of filter
4—corrugated sheet
5—perforated opening
6—cigarette cylinder
7—wrapping paper of filter element B 8—wrapping paper of filter element A
A—filter element A
B—filter element B.

Figure 1:
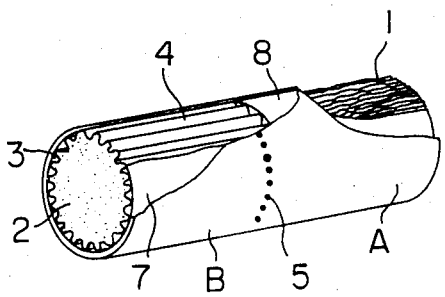
FIG. 1 is a perspective view of the filter plug of this invention, including some opened parts.
Figure 3:
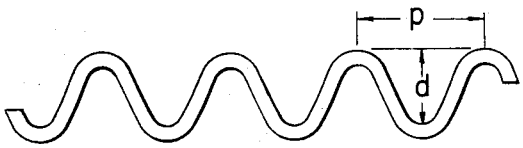
FIG. 3 is a cross-sectional view of a corrugated sheet prepared by subjecting a thermoplastic fiber web to plasticization processing by means of corrugated roller.
Figure 5:
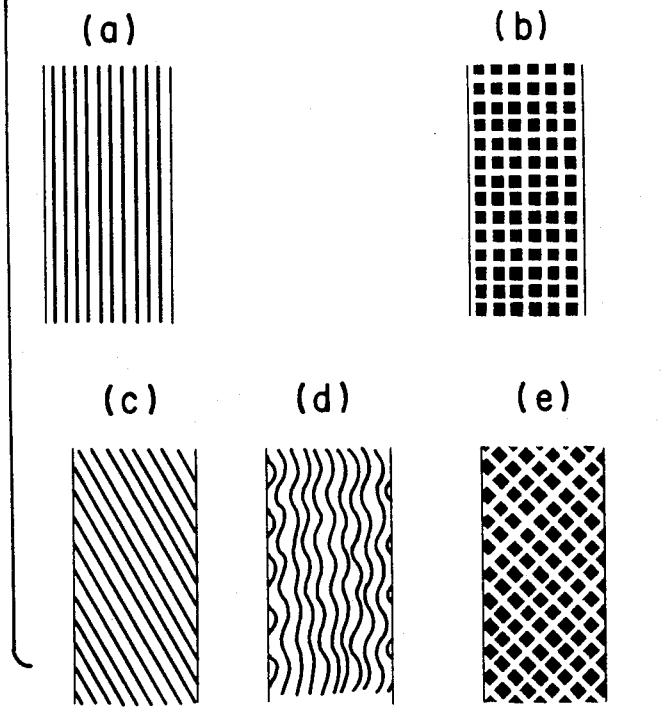
FIG. 5 is a top plan view of a sheet prepared by subjecting a thermoplastic fiber web to plasticization processing by means of corrugated roller.

FIG. 1 is a perspective view, including some opened parts, of the filter plug of this invention, wherein (1) is filter material part of filter element A which is made of long fiber tow, and the filter element A is nearly the same as hitherto known plane type filter in structure. In the figure, (2) is core filter material made of long fiber tow constituting the core of filter element B, which has been prepared by once opening a long fiber tow and then assembling it. In FIG. 1, (4) is a corrugated sheet of which cross-section has grooves having a depth of d and wave-wave distance p as shown in FIG. 3 which has been formed into a sheet from, for example, plasticized long acetate fiber's tows having been formed by means of a hot roller having grooves of which pattern is shown in FIG. 5. So as to make approximately one round, (4) is wrapped over the outer layer periphery of long fiber tow (2) as a core filter material and its outer layer periphery is further surrounded by rolling paper (7), whereby flute (3) is formed in the longitudinal direction of the filter plug. In FIG. 1, (5) is perforated openings optionally provided on the outer periphery of filter element B.

Figure 2:
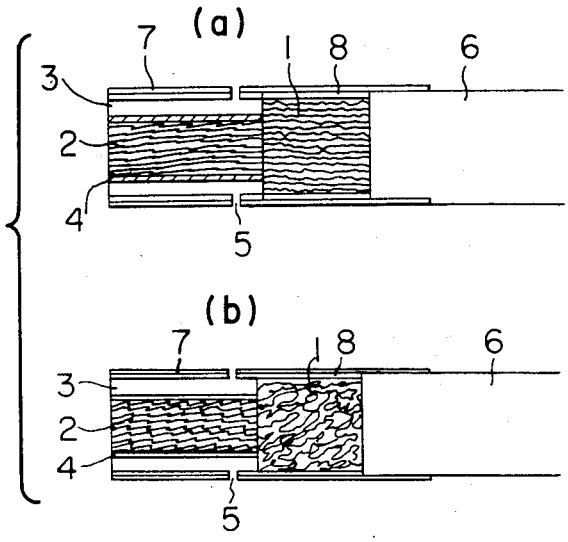
FIG. 2 is a cross-sectional view of the filter plug of this invention which is joined to a cigarette.

FIG. 2 is cross-sectional view of the filter cigarette prepared by attaching the dual type filter plug of this invention to cigarette cylinder (6).

The dual structure filter of this invention has an important characteristic feature that the particulate components and tar, called the harmful components of cigarette smoke, can be removed with relative easiness without increased resistance to suction by changing the combination of long fiber tow of filter element A and long fiber tow used as core material of filter element B.

Figure 4:
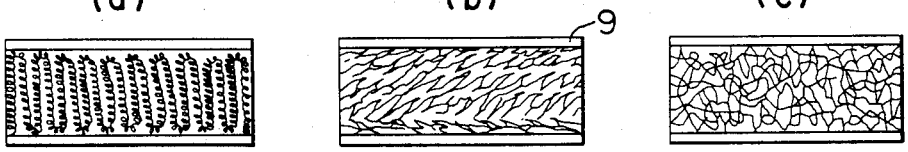
FIG. 4 is a cross-sectional view of filter element B.

Filter element A constituting the dual structure filter of this invention may be a plane type filter shown by A in FIG. 1, or it may also be an element shown in (a), (b), and (c) of FIG. 4 which has been prepared by packing a long fiber tow having a total denier of 1,000–80,000 into a forming mold or the like by means of air jet nozzle so the direction of the fiber becomes relatively perpendicular to the longitudinal direction of filter plug.

The elementary material of the long fiber tow constituting filter element A is preferably acetate fiber, polypropylene fiber, rayon fiber or the like, and its shape is not limited to circular form but yarns having irregular cross-section such as Y-formed cross-section may also be used. Fineness of single fiber is usually 0.1–4 deniers. In order to obtain a product having a particularly high efficiency of removal, a tow having a single fiber fineness of 4 denier or less is preferably used.

Filter element B which is another constituent of the dual structure filter of this invention has a structure shown in B of FIG. 1. The air permeability of the corrugated outer layer sheet of filter element B must be adjusted to 8 liters/minute or less by subjecting a thermoplastic fiber web (for example, long fiber tow consisting of polyolefin, polyester, polyamide, cellulose acetate or the like; assembly of short fiber; or unwoven cloth made therefrom) optionally containing a plasticizer to a corrugating processing. In this invention, air permeability means a value 10 times of the amount of air passing through an area of 1 $cm^2$ per one minute under a pressure difference of 10 mm $H_2O$, at a humidity of 65% RH and at a temperature of 20° C. If air permeability of the corrugated sheet exceeds 8 liters/minute the smoke passing through the filter is diluted by external air unnecessary. Further, when perforated openings are provided as shown by (5) in FIG. 1 for the purpose of introducing the external air, the air can pass through the corrugated sheet to lower the removal efficiency of the filter.

As for the structure of groove to be given to the sheet, it is not limited to a groove formed in the longer direction of the sheet, but the structures shown in (a)–(e) of FIG. 5 can also be used, provided that the grooves of the sheet must form a continuous passage extending to the longer direction of filter plug when the sheet has been formed into a filter. Recommendably, depth d of the groove falls in the range of 0.1–1.0 mm and distance p between groove falls in the range of 0.5–1.5 mm, as shown in FIG. 3. As the elementary filter material to be packed inside the sheet-formed product as a core, a material made from long fiber tow of polyolefin, vinylon, rayon or acetate may be used either alone or in the state of combination of two or more. It is unnecessary to adjust the single fiber fineness of these fibers to any particular value.

A typical example of the dual structure of this invention is shown in FIG. 1. In making a filter having such a structure, filter element A and filter element B are prepared first of all. Filter element A may be prepared by the usual method for making a filter as mentioned in Japanese patent publication Nos. 6903/1982 and 6904/1982. Filter element B may be prepared according to, for example, the method mentioned in Japanese patent application Kokai (Laid-open) No. 68282/1980. The filter elements A and B, prepared by such methods, are then joined together by means of a rolling paper, and optionally perforated openings (5) expressed by (5) of FIG. 1 may be provided thereon.

The cigarette filter plug of this invention, having a dual structure, has an important characteristic feature that it can remove the harmful components contained in cigarette smoke, such as particulate components and tar, without increased resistance to air passage unlike the filter plugs hitherto developed so that a feeling of sufficiency of smoking can be obtained.

Hereunder, this invention will be explained in more detail with reference to the following example.

EXAMPLE 1

First, filter element B was prepared by using cellulose diacetate fiber or polypropylene fiber as sheet-forming elementary material, as shown in Table 1. When acetate fiber was used, triacetin was sprayed to the fiber as a plasticizer, and then the fiber was formed into a corrugated sheet having a cross-section shown in FIG. 3 by means of corrugated hot roller shown in FIG. 5 (a). The corrugated sheet thus obtained was wrapped over the outer periphery of an elementary material used as core to give filter element B. On the other hand, filter element A was prepared as shown in Table 1 according to the usual method for preparing a filter plug.

The filter element A and the filter element B were combined. It was connected to one end of cigarette as shown in FIG. 2, and smoked by a smoking machine. The removal rates of the particulate components, tar and nicotine present in the cigarette smoke and the amount of carbon monoxide contained in the passing smoke produced from one cigarette were measured to obtain the results shown in Table 1.

The quantities mentioned in Table 1 were measured in the following manner.

Amount of carbon monoxide: The cigarette was smoked by means of a constant flow type automatic smoking machine at a flow rate of 17.5 ml/second, for a smoking time of 2 seconds, at smoking intervals of 58 seconds and up to a cigarette combustion length of 50 mm, and the main flow smoke was collected into a polyethylene bag. This sample was quantitatively analyzed by gas chromatography. The amount of carbon monoxide was expressed by the weight of carbon monoxide passing the filter per one cigarette.

Air passage resistance: A filter plug and a U tube pressure gauge were connected to vacuum pump in parallel, and suction was carried out. The air passage resistance was expressed by the reading on U tube pressure gauge given when air flow passing the filter plug has reached 17.5 ml/second.

TPM, tar, nicotine removal rate: The filter plug part was removed from commercial cigarette "Hilite", and one end of the remaining paper-rolled cigarette was connected to one end of filter plug to be tested by means of cellophane tape. It was automatically smoked by means of a constant flow type automatic smoking machine at a flow rate of 17.5 ml/second, for a smoking time of 2 seconds, at smoking intervals of 58 seconds and up to a cigarette combustion length of 50 mm. The main flow smoke was collected by means of Cambridge filter. The TPM, tar and nicotine collected in the filter plug and the Cambridge filter were analyzed, from which their removal rates were calculated.

Air permeability: Air permeability was expressed by the amount of air permeating per one minute through an area of 10 $cm^2$ of sheet under a pressure of 100 mm $H_2O$.

TABLE 1

| | Filter element A | | | | | Filter element B | | | |
|---|---|---|---|---|---|---|---|---|---|
| | | | | | | Characteristics of sheet-formed product | | | |
| No. | Material | denier per filament | Shape of filament cross-section | Total denier | Length of filter element (mm) | Material | (mm) | (mm) | Air permeability (liter/min) |
| 1 | Cellulose diacetate | 4 | Y | 43,000 | 20 | – | – | – | – |
| 2 | Cellulose diacetate | 2 | Y | 40,000 | 20 | – | – | – | – |
| 3 | Cellulose diacetate | 2 | " | 40,000 | 8 | Cellulose diacetate | 1.0 | 1.5 | |
| 4 | Cellulose diacetate | 2 | " | 40,000 | 8 | Cellulose diacetate | 1.0 | 1.5 | |
| 5 | Cellulose diacetate | 2 | " | 40,000 | 8 | Cellulose diacetate | 1.0 | 1.5 | |
| 6 | Cellulose diacetate | 1.7 | " | 40,600 | 8 | Cellulose diacetate | 1.0 | 1.5 | |
| 7 | Rayon | 3 | circu- | 45,000 | 2 | Cellulose | 1.8 | 1.2 | |

TABLE 1-continued

| | | | | | | | | | |
|---|---|---|---|---|---|---|---|---|---|
| | | | lar | | | diacetate | | | |
| 8 | Cellulose diacetate | 3 | Y | 46,000 | 15 | Poly-propylene | 1.5 | 0.2 | 5.0 |
| 9 | Cellulose diacetate | 2 | Y | 40,000 | 10 | Cellulose diacetate | 1.0 | 0.2 | 7.8 |

| Filter element B | | | | | | | | |
|---|---|---|---|---|---|---|---|---|
| Elementary fiber material used as core | | | Length | Air passage resis- | | | | |
| Material | denier per filament | Shape of filament's cross-section | of filter element (mm) | tance of element (mm $H_2O$) | perfo-rated opening | Removal rate (%) TPM | Tar | Nicotine |
| — | — | — | — | 47 | Absent | 41 | 38 | 31 |
| — | — | — | — | 82 | Present | 61 | 58 | 51 |
| Cellulose diacetate | 4 | Y | 17 | 48 | Present | 71 | 70 | 52 |
| Cellulose diacetate | 4 | Y | 17 | 48 | Present | 46 | 43 | 35 |
| Cellulose diacetate | 4 | Y | 17 | 100 | Present | 78 | 70 | 73 |
| Cellulose diacetate | 1.7 | Y | 46 | 60 | Present | 67 | 65 | 56 |
| Cellulose diacetate | 3 | Y | 10 | 55 | Present | 56 | 52 | 49 |
| Cellulose diacetate | 3 | Y | 10 | 52 | Present | 54 | 50 | 45 |
| Rayon | 2 | circular | 10 | 53 | Present | 53 | 49 | 48 |

What is claimed is:

1. A cylindrical filter plug having an axial core of filter material and an outer skin of wrapping paper which permits air to pass therethrough, the core comprising a first filter element and a second filter element axially arranged and jointed to each other, the first filter element comprising a crimped long fiber tow, the second filter element comprising a core of long fiber tow peripherally surrounded by a corrugated sheet having grooves extending in the longitudinal direction of the filter plugs, the corrugated sheet having an air permeability of 0.005 to 8 liters/minute.

2. The filter plug of claim 1, wherein the wrapping paper is air permeable.

3. The filter plug of claim 1, wherein the wrapping paper has peripherally arranged openings.

4. The filter plug of claim 1, wherein the corrugated sheet is prepared by subjecting a thermoplastic fiber web to plasticization processing by means of a corrugated roller.

5. The filter plug of claim 4, wherein the thermoplastic fiber web comprises cellulose acetate tow.

6. A cigarette comprising the filter plug of claim 2 and a cigarette cylinder axially joined thereto, wherein the air resistances of the cigarette cylinder, the first filter element, the wrapping paper, the core of the second filter element and the grooves of the corrugated sheet are adjusted; so that cigarette smoke passes through the cigarette cylinder, the first filter element and the core of the second filter element, and ventilation air passes through the wrapping paper and the grooves in the corrugated sheet, when the cigarette is smoked.

7. The cigarette according to claim 6, wherein the wrapping paper has openings for passage of the ventilation air.

8. A cylindrical filter plug having an axial core of filter material and an outer skin of wrapping paper which permits air to pass therethrough, the core comprising a first filter element and a second filter element axially arranged and joined to each other, the first filter element comprising a crimped long fiber tow, the second filter element comprising a core of long fiber tow peripherally surrounded by a corrugated sheet having grooves extending in the longitudinal direction of the filter plugs.

9. A cylindrical filter plug having an axial core of filter material and an outer skin of wrapping paper which permits air to pass therethrough, the core comprising a first filter element and a second filter element axially arranged and joined together, the first filter element comprising a crimped long fiber tow, the second filter element comprising a core of long fiber tow peripherally surrounded by a corrugated sheet having grooves extending in the longitudinal direction of the filter plugs, the corrugated sheet having an air permeability sufficient to pass air therethrough and $\leqq 8$ liters/minute.

* * * * *